United States Patent [19]

Lam et al.

[11] Patent Number: 4,924,627

[45] Date of Patent: May 15, 1990

[54] DOWN STOP FOR CROSS ARM WINDOW REGULATOR

[75] Inventors: Michael K. Lam, Southfield; Bohdan Kazewych, Rochester, both of Mich.

[73] Assignee: General Motors Corporation, Detroit, Mich.

[21] Appl. No.: 415,838

[22] Filed: Oct. 2, 1989

[51] Int. Cl.[5] ..... E05F 11/44

[52] U.S. Cl. ..... 49/351

[58] Field of Search ..... 49/348, 350, 351, 359, 49/363, 227; 74/526

[56] References Cited

U.S. PATENT DOCUMENTS

| | | | |
|---|---|---|---|
| Re. 19,133 | 4/1934 | Ball | 49/227 |
| 4,106,353 | 8/1978 | Kondo | 49/227 |
| 4,221,079 | 9/1980 | Becker | 49/227 |
| 4,653,230 | 3/1987 | Seo et al. | 49/227 |

*Primary Examiner*—Gary L. Smith
*Assistant Examiner*—Jerry Redman
*Attorney, Agent, or Firm*—William A. Schuetz

[57] ABSTRACT

A down stop for a cross arm window regulator for moving a vehicle window between open and closed position is provided. The down stop comprises an elongated slider means which can either be fixed or made adjustable in length which is slidably received within a sash channel secured to the lower end of the window and between the guides carried by the cross arms of the cross arm window regulator. The slider means has its opposite ends engageable with the guides on the cross arm window regulator when the window has been moved to a fully open position to prevent further movement of the window.

7 Claims, 2 Drawing Sheets

DOWN STOP FOR CROSS ARM WINDOW REGULATOR

The present invention relates to a down stop for a reciprocably movable window of an automotive vehicle and, more particularly, to a down stop slidably carried by a sash channel on the window and which is cooperably engageable with the arms of a cross arm window regulator mechanism to stop further movement of the window when it reaches its fully open position.

In automotive vehicles having windows which are reciprocably movable vertically between closed and open positions, it is common to provide a down stop or down stops which are engaged by the window when it is fully lowered to the desired fully open position to prevent further movement of the window. These down stops are usually resilient members carried by a bracket welded or mounted to the body structure or door of the vehicle. The down stops are engageable by the lower edge of the window when the latter is fully lowered in response to operation of a window regulator mechanism to prevent further downward movement.

While these known down stops have been successful in operation, they nevertheless require a separate bracket or shelf to be secured to the vehicle door or body structure and require an assembly operation to secure the down stops in place.

In accordance with the provisions of the present invention, a novel down stop or down stop means slidably carried by the sash channel is provided. The down stop means can either be of a predetermined length or have means for adjusting its length and is located between a pair of guides slidably received in the sash channel and which are carried by the arms of a cross arm window regulator mechanism. The guides of the window regulator mechanism engage the opposite ends of the down stop means when the window has been moved to its fully open position to prevent further movement of the window by the window regulator mechanism.

Accordingly, a broad object of the present invention is to provide a new and improved down stop means for use with a cross arm window regulator mechanism for moving a vehicle window vertically between open and closed positions, and in which the down stop means comprises a slider means slidably carried by a sash channel secured to the window and whose opposite ends are engageable with the cross arms of a cross arm window regulator mechanism when the window has been lowered to a fully open position so that further downward movement of the window is prevented.

Another object of the present invention is to provide a new and improved down stop means, as defined in the preceding object, and wherein the down stop means is of a relatively inexpensive and economical construction, can be easily inserted into the sash channel carried by the window and which can either be of a predetermined length or be made adjustable in length so to enable the fully lowered position of the window to be varied.

Another objection of the present invention is to provide a new and improved down stop means, as defined in the preceding objects, and in which the down stop means comprises a slider means slidably carried by the sash channel secured to the vehicle window adjacent its lower edge, and in which the slider means comprises a pair of slider members located between guides carried on the ends of the cross arms of the cross arm window regulator and which are also movably received within the sash channel, and wherein the slider means includes a bumper means disposed between the pair of sliders so that by varying the length of the bumper means, the overall length of the slider means can be varied so that the fully open position of the window with respect to the belt line of the vehicle can be varied.

A further object of the present invention is to provide a new and improved down stop means, as defined in the first enumerated object, and wherein the down stop means comprises a slider means comprising a pair of slider members having overlapping ends provided with transverse spaced apertures therethrough and a plug member which can be inserted through aligned apertures in the ends of the two slider members to enable the overall length of the slider means to be adjusted.

The present invention further resides in various novel constructions and arrangement of parts, and further objects, novel characteristics and advantages of the present invention will be apparent to those skilled in the art to which it relates and from the following detailed description of the illustrated, embodiments thereof made with reference to the accompanying drawings forming a part of this specification and in which similar reference numerals are employed to designate corresponding parts throughout the several views, and in which.

Figure 7:
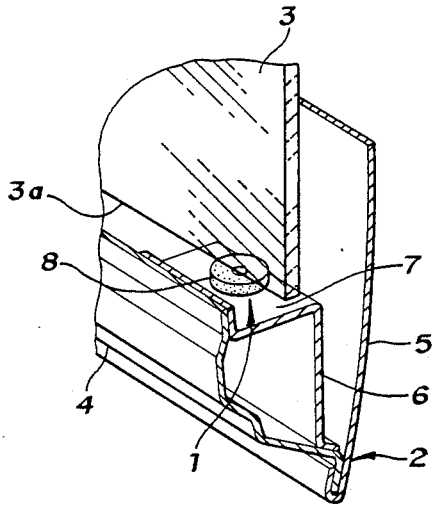
PRIOR ART Fig. 7
FIG. 7 is a fragmentary perspective view showing a prior art type down stop means.

FIG. 7 shows a common type of down stop 1 previously employed in automotive doors 2 having a window 3 which is movable between open and closed positions. As shown, the door 2 has an inner panel 4 and an outer panel 5. To provide the down stop 1, a bracket or shelf 6 is welded to the inner panel 4 of the door 2 to provide a generally horizontal surface 7 onto which a resilient bumper or stop 8 is mounted. In this conventional practice, when the window 3 is moved to its fully open position, the lower edge 3*a* thereof engages the resilient stop 8 and prevents further movement of the window 3 downwardly. Although such down stops 1 having been successful in operation, they, nevertheless, require additional assembly operations to be performed on the door 2.

Figure 1:
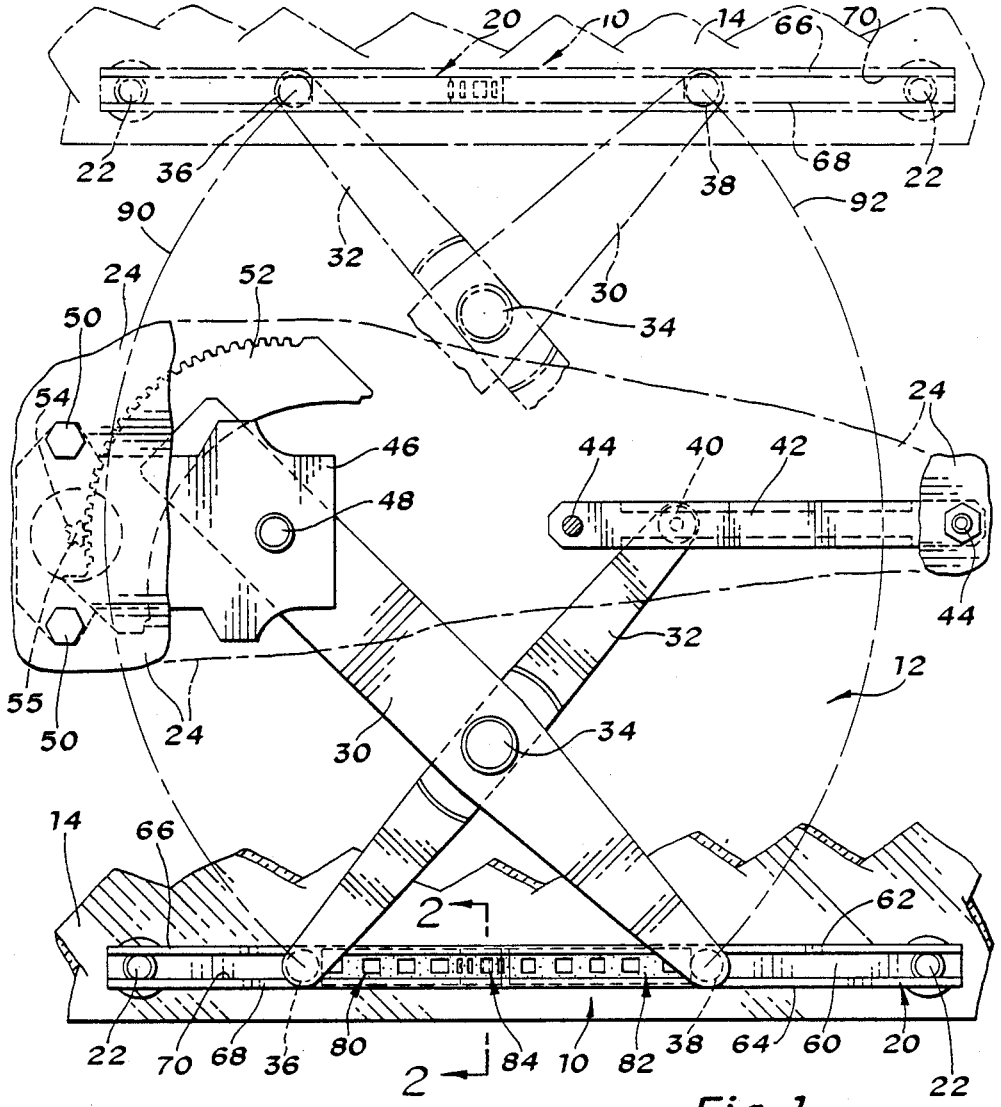
FIG. 1 is a fragmentary side elevational view of a vehicle window and door panel for carrying a cross arm window regulator mechanism and illustrating the preferred embodiment of the novel down stop means of the present invention.

As best shown in FIG. 1, the present invention provides a novel down stop means 10 for use with a cross arm window regulator mechanism 12 which is operable to move a vehicle window 14 between and an upper closed position, as shown by the phantom lines in FIG. 1, and a lower position, as shown by the solid lines in FIG. 1.

Figure 2:
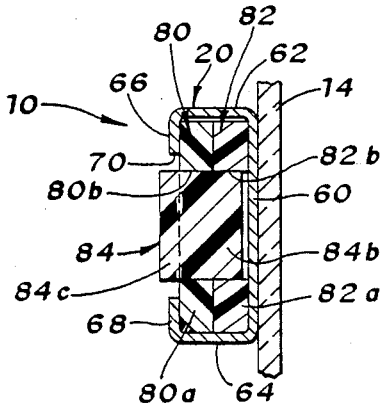
FIG. 2 is an enlarged fragmentary sectional view taken approximately along line 2—2 of FIG. 1.
Figure 3:
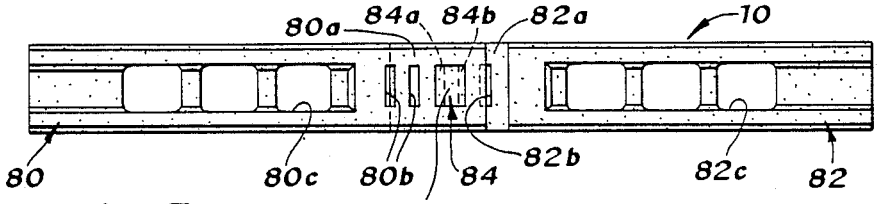
FIG. 3 is an enlarged elevational view of the preferred embodiment of the novel down stop means of the present invention.

The window 14 adjacent its lower edge has secured thereto a sash channel 20. As best shown in FIGS. 1 and 2, the sash channel 20 is linear and horizontally disposed and is of a C-shaped cross section. The channel 20 is adapted to be secured to the window 14 by suitable or conventional fasteners 22. The window 14 is adapted to be slidably guided for movement between its fully open position, as shown by the solid lines in FIG. 1, and its fully closed position, as shown by the phantom lines in FIG. 1, by suitable or conventional guide channels (not shown) carried by a vehicle door (also not shown except for inner panel 24 in FIG. 1). The inner panel 24 of the door supports the cross arm window regulator mechanism 12.

The cross arm window regulator mechanism 12 could be of any suitable or conventional construction that is hereshown as comprising a pair of arms 30, 32 which are pivotally connected intermediate their ends by a pivot pin means or rivet 34. The arms 30, 32 at one end thereof (the lower ends as shown by the solid lines in FIG. 1) pivotally or rotatably carry a pair of guide rollers 36, 38, respectively. The guide rollers 36, 38 are rollably received within the C-shaped sash channel 20. The arm 32 at its other end also carries a rotatable or pivotable roller 40 which is slidably received within a C-shaped linear channel 42 secured to the inner panel 24 via fasteners 44. The C-shaped channel 42 is horizontally disposed, as shown in FIG. 1. The arm 30 at its other end is pivotally connected to a bracket 46 via a pivot pin means or rivet 48, the bracket 46 in turn being mounted to the inner panel 24 of the door via fasteners 50. The end of the cross arm 30 remote from the roller 38 is welded or otherwise secured to a conventional sector gear 52, the sector gear in turn being in meshed engagement with a pinion 54. The pinion 54 is fixed to a shaft 55 which is rotatably supported by the bracket means 46 and extends to within the interior of the vehicle. The shaft 55 would have a handle (not shown) attached thereto to enable the pinion gear 54 to be rotated in opposite directions.

The C-shaped sash channel 20 has a bottom or back wall 60, a top side 62, a bottom side 64 and upper and lower inwardly turned flanges 66, 68. The flanges 66, 68 define an elongated linearly extending slot 70 facing in a direction away from the window 14. The rollers 36, 38 carried by the cross arms 30, 32, respectively, would have a diameter larger than the width of the slot 70 so that they are retained within the sash channel 20. The roller 40 is retained within the guide track 42 in the same manner as the roller 46 is retained in the sash channel 20.

Figure 4:
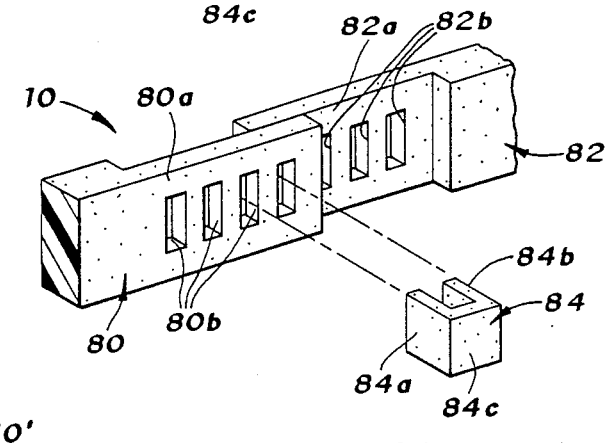
FIG. 4 is a fragmentary perspective view of the down stop means shown in FIG. 3 and illustrating how the overall length thereof can be adjusted.

In accordance with the provisions of the present invention, a novel down stop means is provided to prevent travel of the window 14 beyond the desired fully open position. FIGS. 1–4 illustrate a preferred embodiment of the down stop means 10. The down stop means 10 comprises a pair of elongated linearly extending sliders or slider means 80, 82 which are shaped substantially complementary with the sash channel 20 and which are slidably received therein between the rollers 36, 38 of the cross arms 30, 32, respectively. The sliders 80, 82 are preferably made from a suitable low friction plastic material and are freely slidable within the sash channel 20. The sliders 80, 82 have a height which is greater than the width of the slot 70 so that they are retained in the sash channel 20. The sliders 80, 82 have adjacent ends **80*a*, 82*a* which are approximately half the thickness of the remaining portion of the sliders 80, 82. As best shown in FIG. 4, the ends 80*a*, 82*a* overlap each other and are provided with a plurality of longitudinal spaced transverse through openings 80*b*, 82*b*, respectively. The openings 80*b*, 82*b* are rectangular in shape. The provision of the overlappings ends 80*a*, 82*a* enable the down stop means 10** to have its overall length adjusted.

The overlapping ends **80*b*, 82*b* are adapted to be secured together by an adjustment means in the form of a plug member 84. The plug member 84 is U-shaped and defines a pair of spaced legs 84*a*, 84*b* and a bight portion 84*c* connecting the legs 84*a*, 84*b*. The legs 84*a*, 84*b* are of a rectangularly shaped cross section and are shaped complementary to the openings 80*b*, 82*b*. When the ends 82*a*, 80*a* are overlapped so that the transverse apertures 80*b*, 82*b* are aligned. The legs 84*a*, 84*b* of the plug member 84 can be inserted through two adjacent aligned pairs of apertures 80*b*, 82*b* until the bight portion 84*c* engages the end 80*a* so that the two sliders are connected together in a manner which prevents relative longitudinal movement therebetween. The legs 84*a*, 84*b* are received in the openings 80*b*, 82*b* with a snug or tight fit so that the plug 84 will not fall out of the openings in the ends 80*a*, 82*a*. The sliders 80, 82 also have a plurality of longitudinally spaced openings 80*c*, 82*c*** in order to reduce their weight and the amount of plastic material needed to make them.

The operation of the down stop means 10 will now be described with reference to operation of the window regulator mechanism 12 for moving the window 14 between its closed and opened positions. When the window 14 is in its fully closed position, the window regulator mechanism and window 14 are in the position shown by the phantom lines shown in FIG. 1. In this position, the roller 36, 38 of the cross arms 30, 32, respectively are located slightly to the outside of the down stop means 10. As shown in FIG. 1, when the window regulator mechanism 12 is actuated to lower the window 14 from its fully closed position towards its open position, the sector gear 52 is rotated in a counterclockwise direction to cause the arm 30 to be pivoted in a clockwise direction. Movement of the arm 30 in a clockwise direction causes the arm 32 to be moved in a counterclockwise direction and with the roller 40 rolling within the guide track 42. During this downward movement of the window 14, the roller 36, 38 of the cross arms 30, 32 move away from each other and away from the down stop means 10 until the sash channel 20 is horizontally aligned with a horizontal plane passing through the pivot 55. The path of movement of the rollers 36, 38 is denoted by the reference numerals 90, 92 in FIG. 1 of the drawings. When the sash channel 20 is further moved so it is below the horizontal plane passing through the axis of the pinion gear 54, the rollers 36, 38 will move towards each other. When the window 14 reaches its fully opened position, the rollers 36, 38 will engage the opposite ends of the down stop means 10, whereupon further movement of the rollers 36, 38 towards each other is prevented. This in turn prevents further movement of the cross arms 30, 32 and thus further movement of the window 10 downwardly.

By making the sliders 80, 82 adjustable relative to each other, the fully open position of the window 14 can be varied to accommodate different vehicle doors having different belt line heights, i.e. the height from the road surface to the top of the door where the window first appears.

Figure 5:
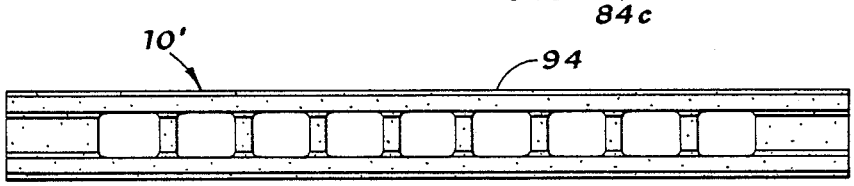
FIG. 5 is a side elevational view of an alternate embodiment of the novel down stop means in accordance with the provisions of the present invention.

FIG. 5 illustrates yet another embodiment of the novel down stop means of the present invention. The down stop means 10' comprises a single rectangular shaped slider 94 shaped complementary with the sash channel 20 and which is freely slidable within the sash channel 20. In this embodiment, the overall length of the slider means 94 is fixed and this variation can be used where adjustment of the down stop and the fully open position of the window is not needed or desired.

Figure 6:
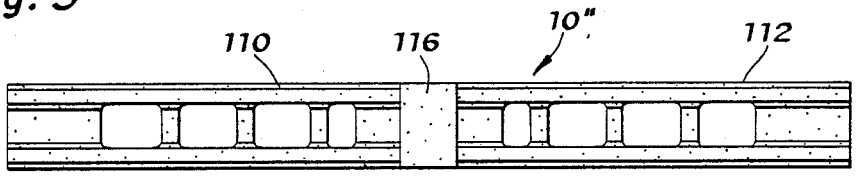
FIG. 6 is a side elevational view of yet another embodiment of the novel down stop means of the present invention.

FIG. 6 shows yet another embodiment of a novel down stop means 10'' of the present invention. In this embodiment a pair of sliders 110, 112 are provided. The sliders 110, 112 are rectangular in shape and are freely slidably received within the sash channel 20. In this embodiment, a rubber or elastomeric bumper 116 is employed. The bumper is located between the adjacent ends of the sliders 110, 112. This embodiment allows for adjustment of the overall length of the slider means 10'' by choosing different lengths of bumpers 116. The bumpers 116 are shaped so as to be freely slidable within the sash channel 20.

From the foregoing, it should be apparent that a novel, simple and economical down stop means has been provided for a cross arm window regulator which merely requires that the slider means be inserted in the sash channel 20 of the window 14 prior to the rollers 36, 38 of the cross arm window regulator mechanism 12 being received within the sash channel 20. This enables the down stop means to be readily put in place when the window regulator mechanism 12 is being connected to the sash channel 20.

Although the illustrated embodiments hereof have been described in great detail, it should be apparent that certain modifications, changes and adaptations may be made in the illustrated embodiments, and that it is intended to cover all such modifications, changes and adaptations which come within the spirit of the present invention.

The embodiments of the invention in which an exclusive property or privilege is claimed are defined as follows:

1. In an automotive vehicle having a window reciprocably movable between closed and open positions and which carries a sash channel adjacent its lower edge, a cross arm window regulator mechanism for reciprocably moving said window between its positions, said mechanism including a pair of arms pivotally connected together intermediate their ends and each being pivotally connected at one end to a guide means, said guide means being movably received within said sash channel at spaced locations, said guide means of said cross arms being movable relative to said sash channel away from each other during a first portion of travel of said window from its closed position toward its open position and then moving relative to said sash channel toward each other during the remaining portion of the travel of the window toward its open position, and a down stop means for preventing further opening movement of the window when the latter reaches its fully open position, the improvement being that said down stop means comprises an elongated slider means which is slidably received within said sash channel between said guide means carried by said cross arms, said slider means at its opposite ends being engageable by said guide means on said cross arms when the window is moved to its fully open position whereby said slider means prevents further movement of said guide means carried by said cross arms toward each other to provide a down stop for said window.

2. In an automotive vehicle having a window reciprocably movable vertically between closed and open positions and which carries a sash channel adjacent its lower edge, a cross arm window regulator mechanism for reciprocably moving said window between its positions, said mechanism including a pair of arms pivotally connected together intermediate their ends and each being pivotally connected at one end to a guide means, said guide means being received within said sash channel at spaced locations, said guide means of said cross arms moving relative to said sash channel away from each other during a first portion of downward travel of said window from its closed position toward its open position and then moving relative to said sash channel toward each other during the remaining portion of the downward travel of the window toward its open position, and a down stop means for preventing further opening movement of the window when the latter reaches its fully open position, the improvement being that said down stop means comprises an elongated slider means which is slidably received within said sash channel between said guide means carried by said cross arms, said slider means at its opposite ends being engageable by said guide means on said cross arms when the window is moved to its fully open position whereby said slider means provides a down stop for said window, and means for longitudinally adjusting the length of said slider means so that the fully open position of said window can be vertically adjusted.

3. In and automotive vehicle, as defined in claim 2, and wherein said slider means comprises a pair of elongated sliders slidably supported by said sash channel and said means for longitudinally adjusting the length of said slider means comprises a bumper member of a predetermined length which is slidably received in said sash channel and located between adjacent ends of said sliders.

4. In an automotive vehicle, as defined in claim 1, and wherein said slider means comprises a pair of elongated sliders separated by a bumper means in engagement with adjacent ends of said sliders.

5. In an automotive vehicle, as defined in claim 2, and wherein said slider means comprises a pair of sliders slidably supported by said sash channel and whose adjacent ends overlap each other and have spaced transverse apertures therethrough, and wherein said means for longitudinally adjusting the length of said slider means comprises a plug member which is inserted through aligned apertures in the overlapping adjacent ends of said sliders.

6. In an automotive vehicle having a window reciprocably movable between open and closed positions and which is provided with a sash channel adjacent its lower edge, a cross arm window regulator mechanism including a pair of arms pivotally connected together intermediate their ends and each being pivotally connected at one end to a guide which is received within said sash channel, said guides of said cross arms moving away from each other during a first portion of travel of the window from its closed position toward its open position and then moving toward each other during the remaining portion of the travel of the window to its open position, and a down stop means for limiting further movement of the window when it reaches its fully open position, the improvement being that said down stop means comprises a pair of sliders slidably received within said sash channel between said guides, said sliders having adjacent inner ends which overlap each other and which are provided with a plurality of longitudinally spaced apertures therethrough, said sliders at their outer ends being engageable by said guides when window is in its desired open position, and a plug member insertable through aligned apertures in said inner ends of said sliders to prevent relative movement between the sliders whereby said slides when both are engaged by said guides serve as a down stop means for said movable window.

7. In an automotive vehicle, as defined in claim 6, and wherein said plug member is U-shaped to define a pair of spaced legs and a bight portion, said legs being insertable through spaced apart aligned apertures on said inner ends of said sliders to connect the sliders together, said legs engaging said sliders with a tight fit.

* * * * *